US006684534B2

(12) United States Patent
Dodge

(10) Patent No.: US 6,684,534 B2
(45) Date of Patent: Feb. 3, 2004

(54) STEP-IN SNOWSHOE BINDING SYSTEM

(75) Inventor: David J. Dodge, Williston, VT (US)

(73) Assignee: K2 Snowshoes, Inc., Carlsbad, CA (US)

( * ) Notice: Subject to any disclaimer, the term of this patent is extended or adjusted under 35 U.S.C. 154(b) by 0 days.

(21) Appl. No.: 09/966,257

(22) Filed: Sep. 28, 2001

(65) Prior Publication Data

US 2003/0061740 A1 Apr. 3, 2003

(51) Int. Cl.[7] ..... A43B 5/04

(52) U.S. Cl. ..... 36/122; 36/7.6; 36/15; 280/14.2; 280/618

(58) Field of Search ..... 36/7.6, 7.7, 62, 36/15, 122, 123, 124, 125; 280/14.2, 618, 624, 634

(56) References Cited

U.S. PATENT DOCUMENTS

| | | | | | |
|---|---|---|---|---|---|
| 2,142,727 | A | | 1/1939 | Keller | 280/11.35 |
| 3,271,040 | A | | 9/1966 | Spademan | 280/11.35 |
| 3,606,370 | A | | 9/1971 | Spademan | 280/11.35 |
| 3,988,841 | A | | 11/1976 | Salomon | 36/117 |
| 4,042,257 | A | | 8/1977 | Salomon | 280/624 |
| 4,395,055 | A | | 7/1983 | Spademan | 280/624 |
| 4,620,375 | A | * | 11/1986 | Wallace | 36/7.6 |
| 4,871,186 | A | * | 10/1989 | Klosterman | 280/611 |
| 4,973,073 | A | * | 11/1990 | Raines et al. | 280/624 |
| 5,261,689 | A | | 11/1993 | Carpenter et al. | 280/618 |
| D346,419 | S | | 4/1994 | Carpenter | D21/230 |
| 5,299,823 | A | | 4/1994 | Glaser | 280/625 |
| 5,341,582 | A | * | 8/1994 | Liautaud | 36/7.6 |
| 5,356,170 | A | | 10/1994 | Carpenter et al. | 280/618 |
| 5,357,692 | A | * | 10/1994 | Murray | 36/62 |
| 5,520,406 | A | | 5/1996 | Anderson et al. | 280/624 |
| 5,544,909 | A | | 8/1996 | Laughlin et al. | 280/617 |
| 5,690,351 | A | | 11/1997 | Karol | 280/618 |
| 5,722,680 | A | | 3/1998 | Dodge | 280/624 |
| 5,755,046 | A | | 5/1998 | Dodge | 36/117.3 |
| 5,794,362 | A | * | 8/1998 | Polk et al. | 36/97 |
| 5,799,957 | A | | 9/1998 | Okajima et al. | 280/14.2 |
| 5,799,966 | A | | 9/1998 | Haldemann | 280/613 |
| 5,871,226 | A | | 2/1999 | Klubitschko et al. | 280/624 |
| 5,901,471 | A | | 5/1999 | Warner | 36/124 |
| 5,915,721 | A | | 6/1999 | Laughlin et al. | 280/617 |
| 5,941,555 | A | | 8/1999 | Dodge | 280/623 |
| 5,947,508 | A | * | 9/1999 | Graf et al. | 280/616 |
| 5,954,358 | A | | 9/1999 | Bejean et al. | 280/627 |
| 5,957,479 | A | | 9/1999 | Bayer et al. | 280/624 |
| 5,957,480 | A | | 9/1999 | Dodge | 280/624 |
| 5,970,632 | A | * | 10/1999 | Watson | 36/122 |
| 6,050,005 | A | | 4/2000 | Dodge | 36/117.3 |
| 6,065,768 | A | | 5/2000 | Lee | 280/613 |
| 6,099,018 | A | | 8/2000 | Maravetz et al. | 280/624 |
| 6,102,429 | A | | 8/2000 | Laughlin et al. | 280/617 |
| 6,126,179 | A | | 10/2000 | Dodge | 280/14.2 |
| 6,189,913 | B1 | | 2/2001 | Morrow et al. | 280/613 |

* cited by examiner

*Primary Examiner*—M. D. Patterson
(74) *Attorney, Agent, or Firm*—Downs Rachlin Martin PLLC

(57) ABSTRACT

A step-in binding system (20, 220) including a binding (24, 224) and an engagement member (26, 226) for securing a snowshoe to footwear (22). In one embodiment, the binding includes a pivotable latch (78) and a fixed latch (80), each having a pair of catches (116) for engaging a corresponding receiver (110) on the engagement member. The pivotable latch is pivotable between a closed position (CP) and an open position (OP) and is biased into the closed position by a helical rotational spring (100). The binding further includes an adjustment mechanism (32) extending between a toe member (28) and a heel member (30) that allows the distance between the toe and heel members to be selectively changed by a user. In another embodiment, the binding includes a pair of pivotable latches (278, 280), each biased into its closed position by two torsional rotational springs (300).

42 Claims, 8 Drawing Sheets

310
310
312
226
330
328
332
278
300
306
340
348
316
340
346
348
300
342
270
346
306
296
340
296
300
280
342
340
350
300
336
336
338
326

STEP-IN SNOWSHOE BINDING SYSTEM

FIELD OF INVENTION

The present invention is generally related to the field of recreational and sporting equipment. More particularly, the present invention is directed to a step-in binding for a snowshoe.

BACKGROUND OF THE INVENTION

Recreational and sporting equipment are continually being improved to increase their safety, ergonomics and ease of use. For example, in recent years snowshoes have advanced from early embodiments that typically comprised heavy wooden frames, leather webbing and crude leather straps for fastening the snowshoes to footwear. Today, a typical snowshoe comprises a lightweight aluminum frame, polymer webbing and a binding that includes one or more nylon straps, such as instep and heel straps, and devices, such as D-rings and snap connectors, that simplify the task of securing the snowshoe to footwear.

Unfortunately, snowshoe binding technology has generally lagged behind binding technology for other winter recreational and sporting equipment, such as alpine skis, cross-country skis and snowboards. Sophisticated step-in bindings, i.e., bindings that allow users to releasably secure the bindings to mating footwear simply by stepping into the bindings, for skis have been widely available for many years. Step-in bindings for snowboards have also become widely available, albeit more recently. Although the design parameters for step-in bindings for skis, snowboards and snowshoes may differ from one another, snowshoe users and makers alike could benefit from the addition of quality step-in bindings to snowshoes.

Though conventional features of ski and snowboard bindings could be incorporated into bindings for snowshoes, many of these features have at least one shortcoming. For example, conventional ski and snowshoe bindings often comprise relatively complex latch mechanisms that include large and heavy metal parts. Conventional bindings also generally do not have a latching mechanism that provides a one-size-fits-all design. Nor do these bindings provide a mechanism for adjusting the footwear support portion of the binding to adapt the binding to different footwear lengths. In addition, the latch mechanism of conventional bindings are often prone to reduced performance or improper functioning due to the buildup of snow and/or ice between the latches and the corresponding latch receivers on the footwear. Moreover, many conventional bindings can be used only with specially-configured footwear that is largely unsuitable for use other than with the corresponding bindings.

SUMMARY OF THE INVENTION

In a first aspect, the present invention is directed to a binding releasably securable to an engagement member that includes a first side having a first receiver and a second side spaced from the first side and having a second receiver. The binding comprises a base. A first latch engages the base and has a first rotational axis, a first position and a second position. The first latch is pivotable relative to the base between the first position and the second position about the first rotational axis so as to be engageable with the first receiver of the engagement member. A second latch engages the base in spaced relation to the first latch. The second latch is provided for engaging the second receiver. A first rotational spring engages the base and the first latch and has a second rotational axis substantially co-linear with the first rotational axis. The first rotational spring biases the first latch into the first position.

In another aspect, the present invention is directed to a binding capable of resisting a force. The binding comprises a base. A first latch engages the base and has a first rotational axis and a first position and is pivotable into the first position about the first rotational axis. The first latch is configured to receive at least a first portion of the force when the first latch is in the first position so that the first portion of the force biases the first latch into the first position. A first spring engages the base and the first latch. The first spring biases the first latch into the first position when the first portion of the force is not acting on the first latch.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein.

DETAILED DESCRIPTION OF THE INVENTION

Figure 1:
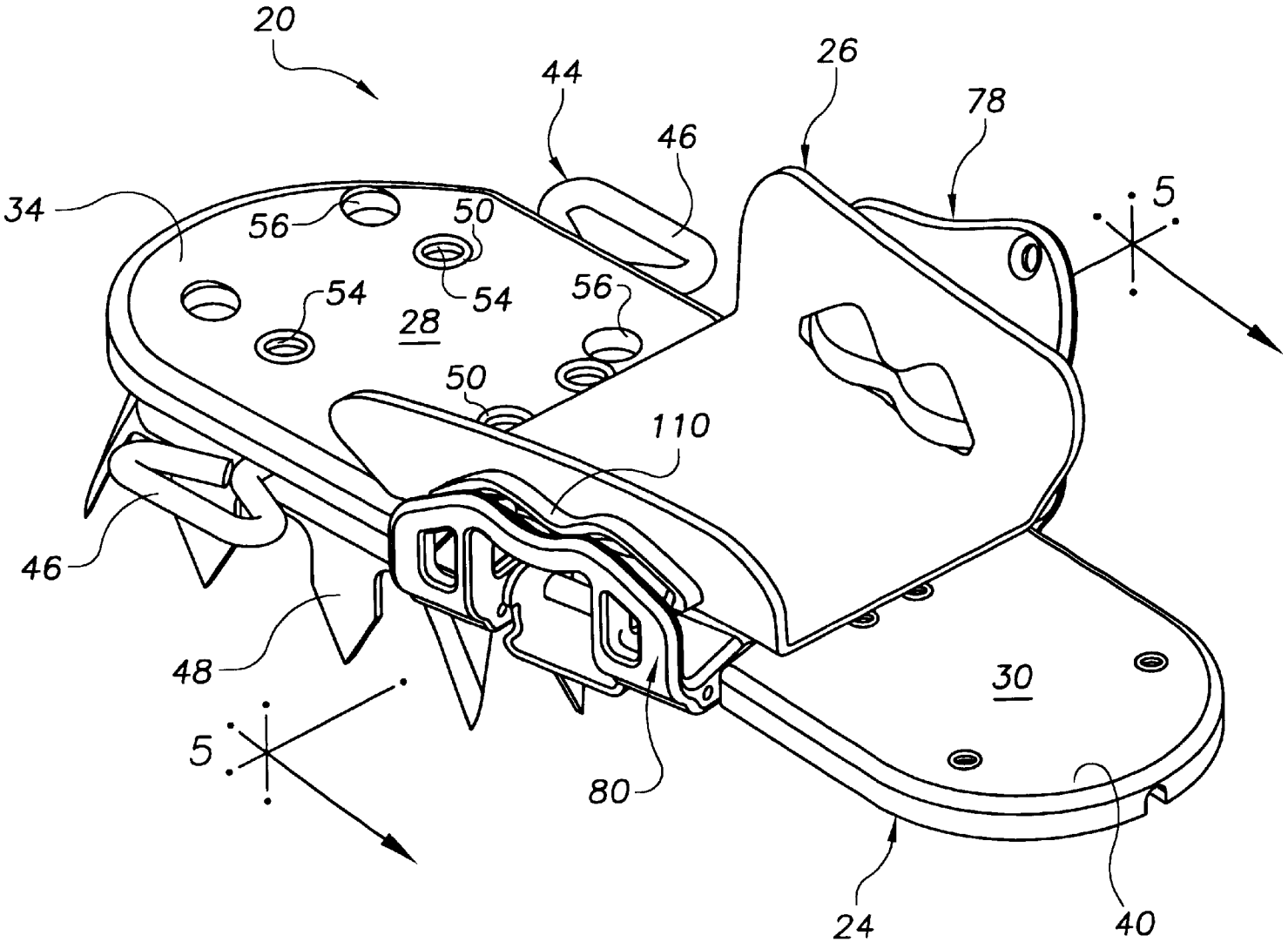
FIG. 1 is a perspective view of one embodiment of a binding system of the present invention.
Figure 2:
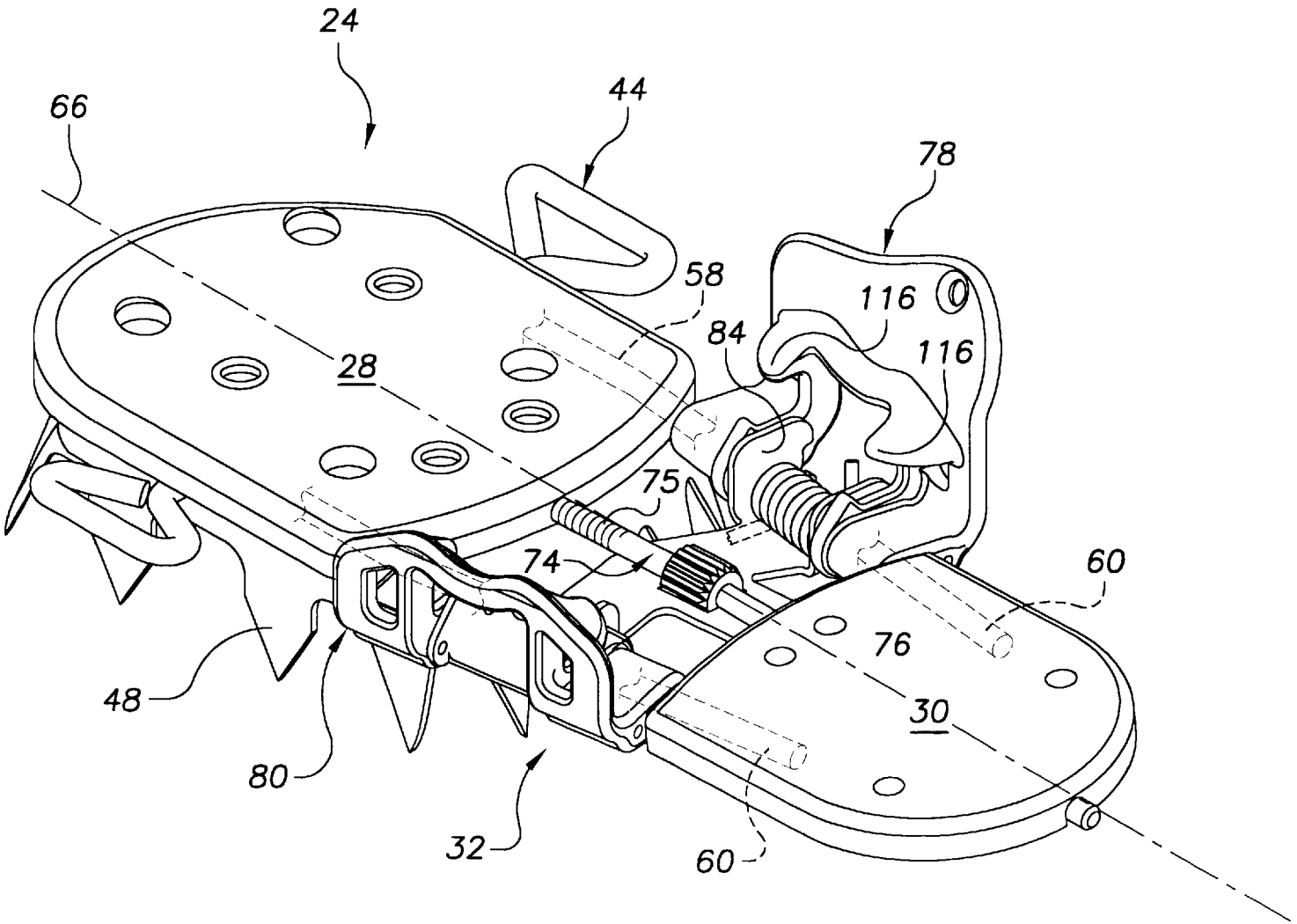
FIG. 2 is a perspective view of the binding of the binding system of FIG. 1, with the engagement member removed.

Referring now to the drawings, wherein like numerals indicate like elements, FIG. 1 shows in accordance with the present invention a binding system, which is generally indicated by the numeral 20. Binding system 20 may be used to secure footwear 22 (FIG. 6), such as a boot, hiking shoe or the like, to a sporting, recreational or other type of device (not shown) that requires the device to be releasably secured to the footwear for its use. Examples of such a device include a snowshoe, a snowboard, an inline skate and a roller skate, among others. Binding system 20 includes a binding 24 that is securable to the device and an engagement member 26 that may be securable to footwear 22 and releasably engagable with the binding. Binding 24 may be referred to as a "step-in" binding, since all that is generally required of a user of binding system 20 to secure the device to footwear 22 is to step into binding 24 such that the binding properly engages, and thereby becomes removably secured to, engagement member 26. In addition to the ease of use, binding system 20 of the present invention has a number of additional desirable features that will become apparent from the following description.

Referring to FIGS. 1–6, binding 24 comprises a toe member 28 and a heel member 30 that are attached to one another by an adjustment mechanism 32 that allows the distance between the toe and heel members to be adjusted to suit a variety of sizes of footwear 22. Upper surface 34 of toe member 28 is generally designed to contact toe region 36 and ball-of-the-foot region 38 of footwear 22. Similarly, upper surface 40 of heel member 30 is generally designed to contact heel 42 of footwear 22. Toe and heel members 28, 30 are preferably made of a relatively stiff material, such as plastic or metal. In the embodiment shown, wherein binding system 20 is intended for use with a snowshoe (see FIG. 6), toe and heel members 28, 30 are preferably made from a material that remains durable when subjected to cold weather temperatures, e.g., from about −30° F. or lower to about 32° F., that the binding system may be exposed to during use, e.g., plastic such as nylon or thermoplastic polyurethane (TPU).

Figure 5:
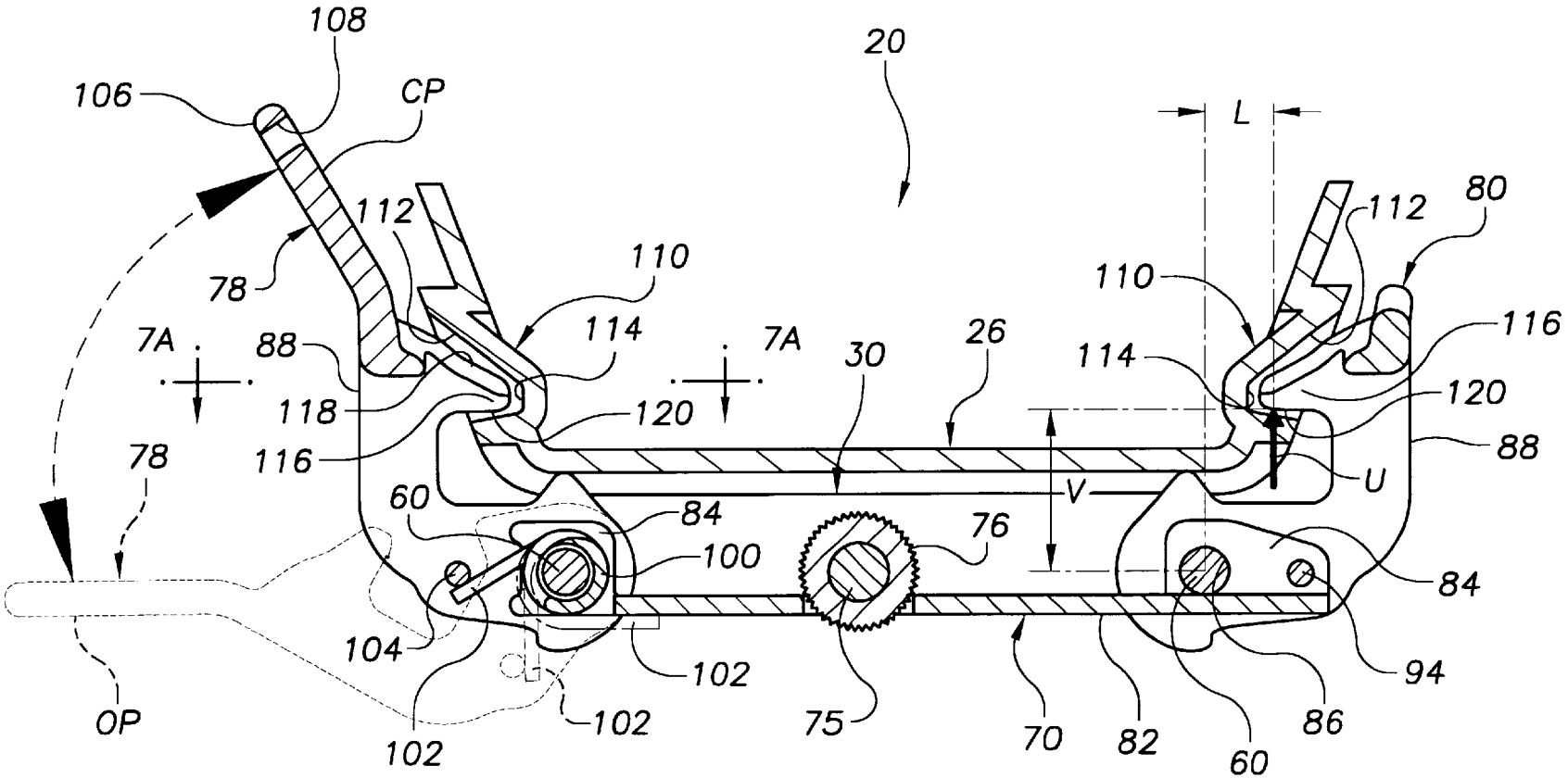
FIG. 5 is a cross-sectional view of the binding and receiver as taken along line 5—5 of FIG. 1.
Figure 6:
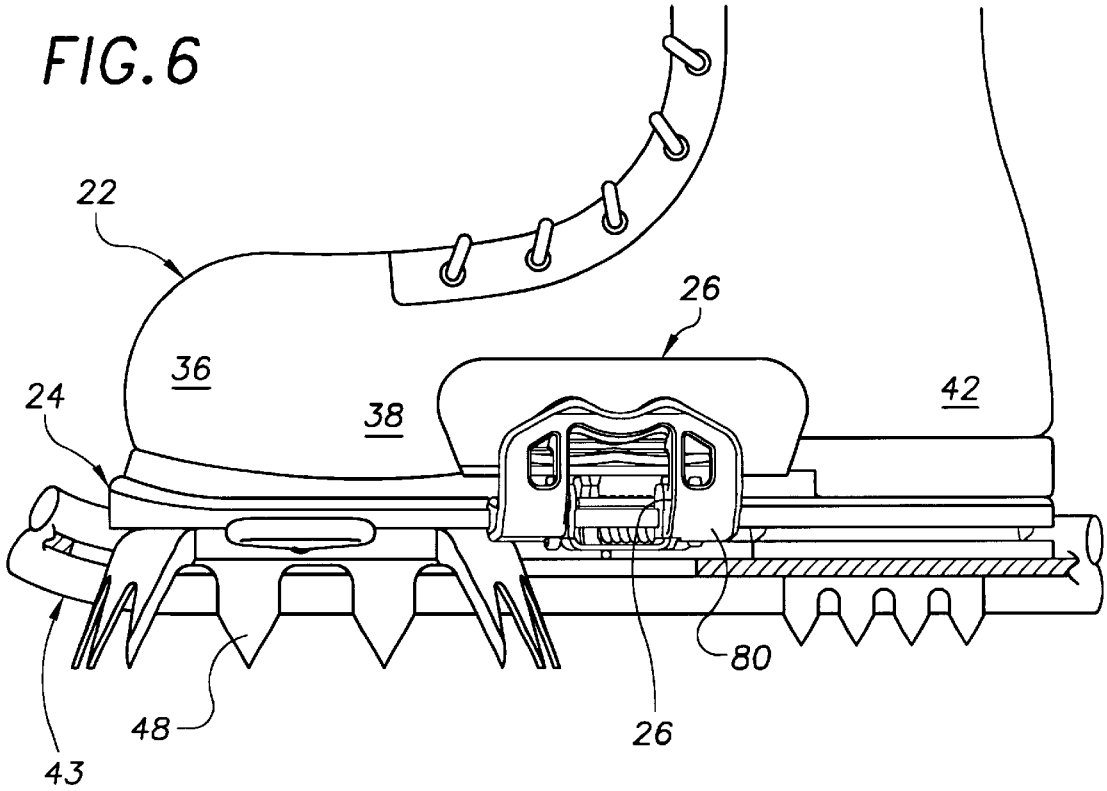
FIG. 6 is an elevational view of the binding system of FIG. 1.

Binding system 20 shown in FIGS. 1–7 is designed to be used with certain devices, e.g., a snowshoe such as snowshoe 43 of FIG. 6, having a floatation device comprising a rigid frame and webbing. Accordingly, binding 24 may include a tie member 44 that engages toe member 28 and allows the binding to be pivotably attached to the frame of the device, e.g., snowshoe 43. Tie member 44 may have a loop 46 or other structure at each of its ends for receiving a strap (not shown) or other member extending between binding 24 and the frame of snowshoe 43 or other device to which the binding is attached. If binding system 20 is used with another type of device not constructed with a rigid frame and webbing or other device, such as a snowboard or a unitary molded snowshoe, the binding may be attached directly to a surface of the device, e.g., using mechanical fasteners, adhesive bonding or other means. One skilled in the art will recognize that any one of a variety of means may be provided for attaching binding 24 to a snowshoe or other device, such that an exhaustive list need not be presented herein. Additionally, if binding system 20 is used with a snowshoe, binding 24 may optionally include a crampon 48 to increase the traction of the snowshoe during use. Crampon 48 may be secured to toe member 28 with, e.g., mechanical fasteners 50, such as rivets, screws or nutted bolts, extending through apertures 52 in the crampon and corresponding apertures 54 in the toe member. Alternate apertures 56 may be provided in toe member 28 to permit the attachment of a crampon (not shown) having a fastener pattern different from the fastener pattern of crampon 48.

Adjustment mechanism 32 includes a connecting member 58 engaging toe member 28 at one of its ends and heel member 30 at its opposite end. Connecting member 58 may be, e.g., a generally U-shaped rod secured to toe member 28 by adhesives, welding, mechanical fasteners, clamps and other devices, as appropriate for the materials used to manufacture binding 24 and the configuration of the connecting member. When binding 24 includes a crampon 48, it may be desirable to clamp connecting member 58 between the toe member and crampon 48. Connecting member 58 is typically made of stainless steel, but may be made from another metal, such as aluminum or titanium, a metallic composite or a non-metallic material, such as a composite containing carbon or other fibers, among others. One skilled in the art will readily appreciate that connecting member 58 may be replaced by any variety of structures, such as a pair of elongate rods taking the place of the legs 60 of the U-shaped rod. In addition, connecting member 58 may engage toe member 28 in another manner, such as being held with generally U-shaped brackets (not shown) or within a like-shaped elongate groove (not shown) molded into the lower surface of the toe member.

Figure 3:
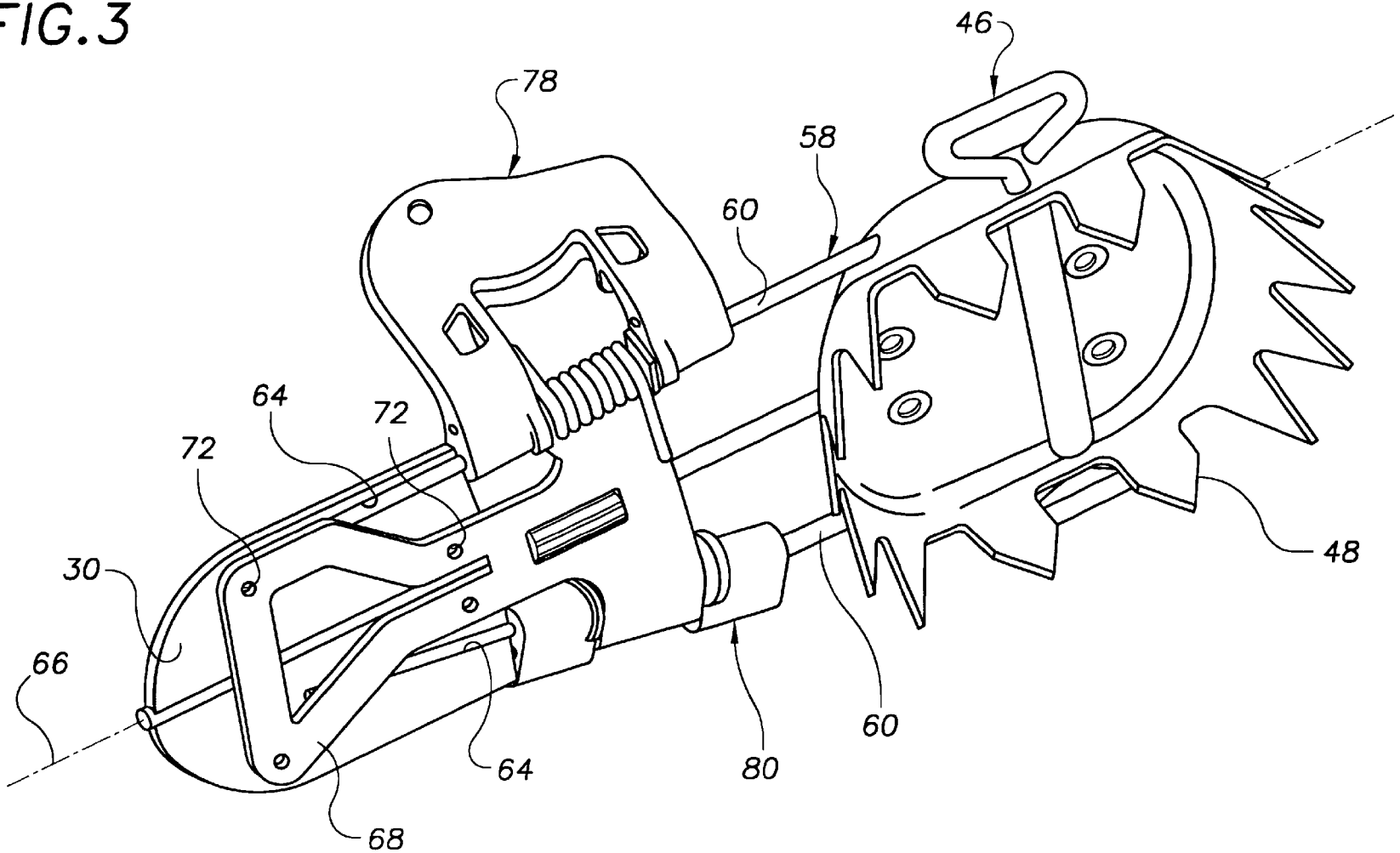
FIG. 3 is a bottom perspective view of the binding of FIG. 2.
Figure 4:
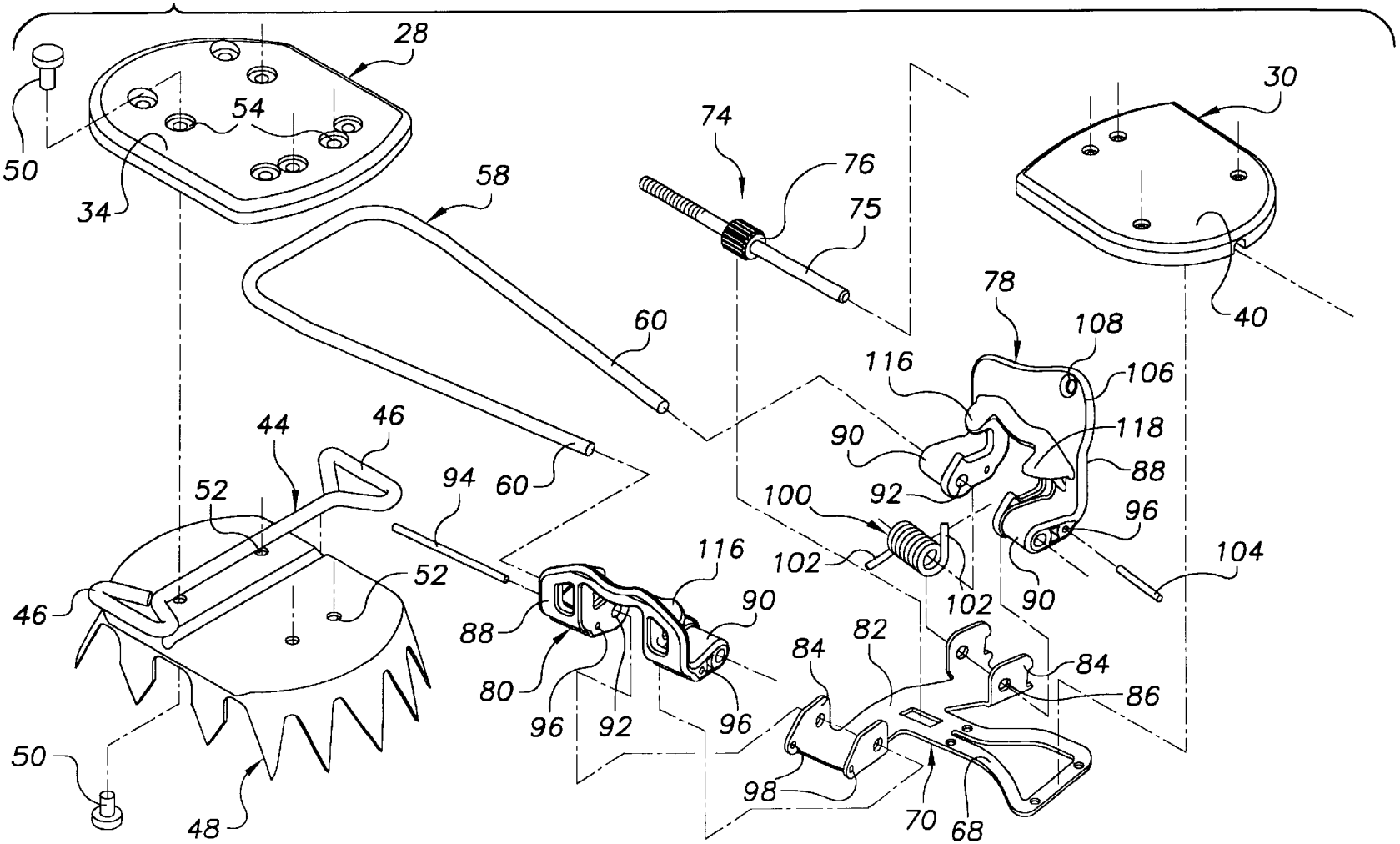
FIG. 4 is an exploded perspective view of the binding of FIG. 2.
Figure 8:
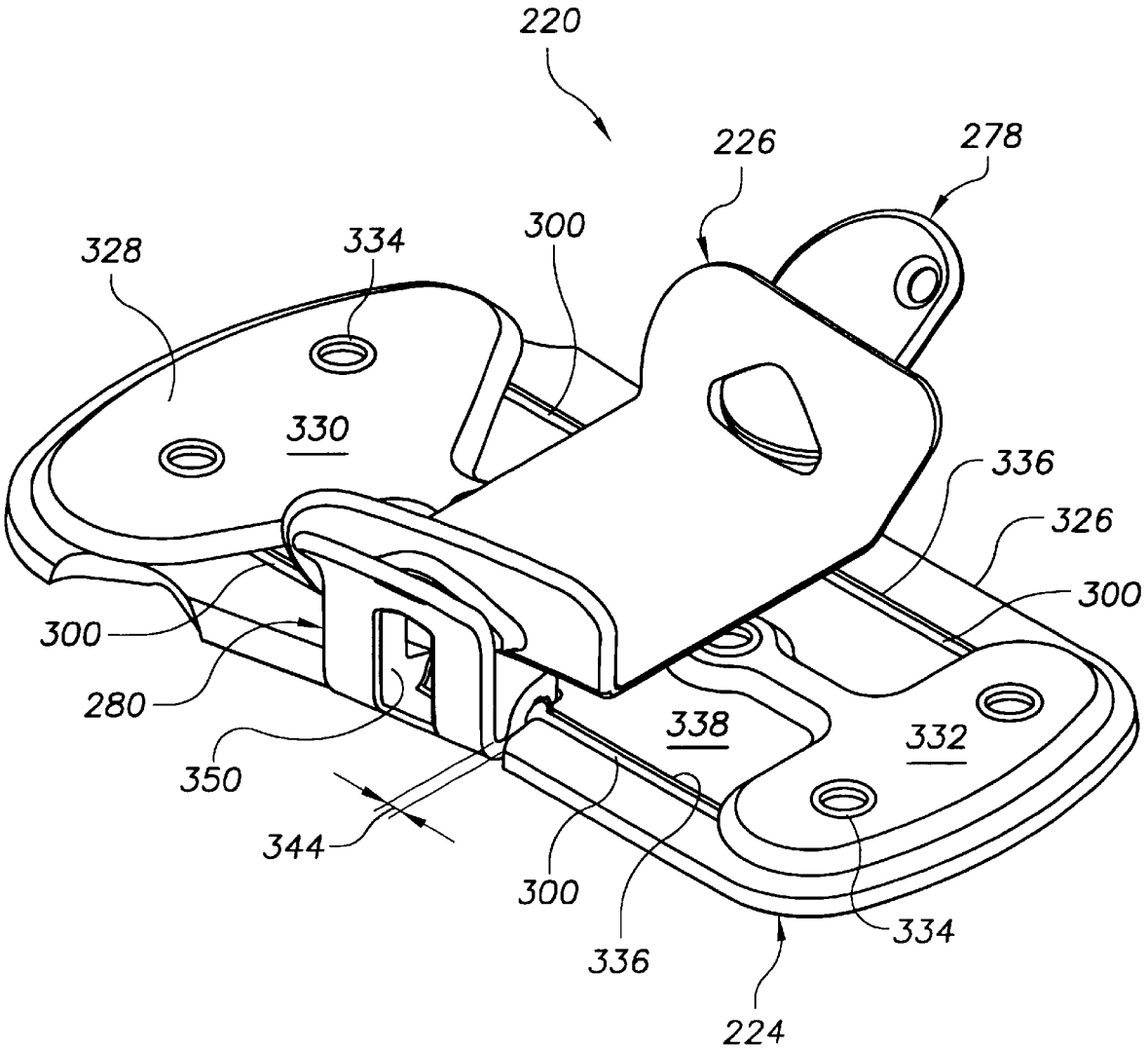
FIG. 8 is a perspective view of another embodiment of the binding system of the present invention.
Figure 9:
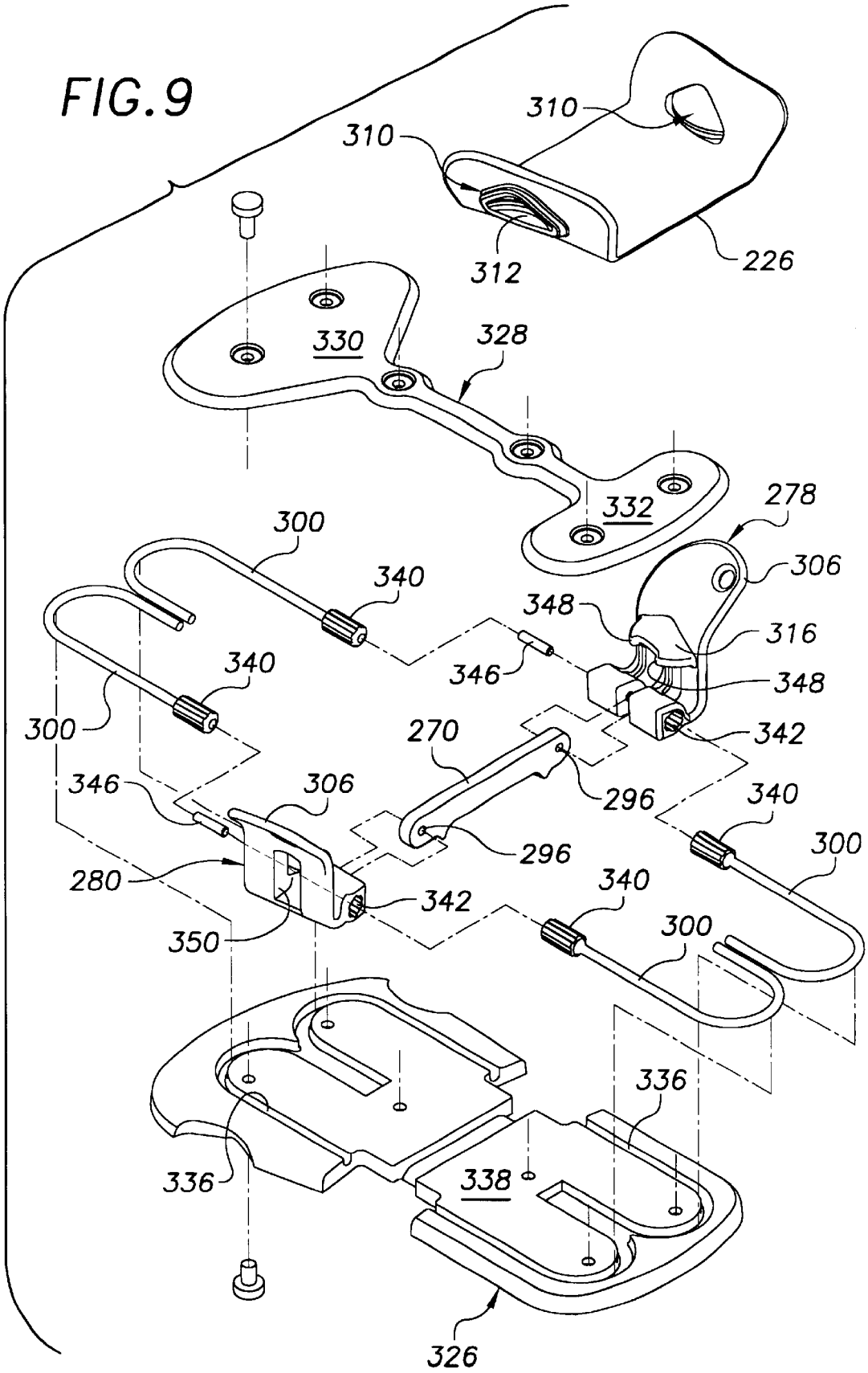
FIG. 9 is an exploded perspective view of the binding system of FIG. 8.

In a preferred embodiment, each leg 60 of connecting member 58 engages a corresponding groove 64 in heel member 30. As best seen in FIG. 3, legs 60 are held within grooves 64 by a portion 68 of a bracket 70 that may be secured to heel member 30 with mechanical fasteners 72, such as rivets, screws, nutted bolts and the like. Legs 60 also may slidably engage toe member 28 to allow the toe member to be selectively moved relative to heel member 30 in a direction generally parallel to the longitudinal axis 66 of binding 24. This allows binding 24 to be adapted to footwear 22 of various lengths. In alternative embodiments, legs 60 may be fixedly attached to toe member 28 so that binding 24 is not adjustable along longitudinal axis 66. Other embodiments may have toe member 28 fixed and heel member 30 slidable or both toe and heel members slidable with respect to connecting member 58. In yet other embodiments, toe member 28 and heel member 30 may be joined to one another to form one large sole member such as shown in FIGS. 8 and 9. One skilled in the art will understand the modifications necessary to make such alternative embodiments.

Adjustment mechanism 32 preferably further includes an adjuster 74, such as an elongate rod 75 rotatably engaging heel member 30 in a stationary manner at one end and threadedly engaging toe member 28 at the other end. In alternative embodiments, the opposite end of the elongate rod 75 may be exclusively threaded or both ends may be threaded with oppositely pitched threads to provide the rotational adjustability. Adjuster 74 may also include a cylindrical grip 76, preferably knurled, that aids a user in rotating the elongate rod about its longitudinal axis. As the user turns grip 76, toe member 28 is moved either toward, or away from, heel member 30, depending upon the direction the user rotates the grip. In this manner, binding 24 may be adjusted along longitudinal axis 66 to accommodate various lengths of different size footwear 22. One skilled in the art will recognize that adjuster 74 may comprise a structure other than threaded rotatable rod 75, such as an elongate member (not shown) that may have a plurality of apertures or recesses disposed along its length, wherein adjustability is provided by engaging a stop, such as a pin or pawl, among others, selectively among the apertures to provide the desired spacing between toe member 28 and heel member 30.

Binding 24 preferably also comprises a pair of spaced-apart latches 78, 80 that may be generally secured to the binding by corresponding legs 60 of connecting member 58 and prevented from moving away from one another during use by bracket 70. As mentioned above, bracket 70 is preferably fixedly attached to heel member 30 and includes a spanner portion 82 and a pair of upstanding tabs 84 (FIG. 4) located at each end of the spanner portion. Each tab 84 includes an aperture 86 that receives a corresponding one of the legs 60 of the connecting member 58. Bracket 70 is typically made of stainless steel. However, other metals, metal composites and non-metallic materials may be used. In alternative embodiments, bracket 70 may have another shape, such as bracket 270 of FIGS. 8 and 9, or, depending upon such parameters as the sizes of toe member 28 and heel member 30 and the strength of connecting member 58, among others, the bracket may be eliminated.

Each latch 78, 80 is preferably generally U-shaped in side view and may have a body 88 and a pair of legs 90 that extend generally toward longitudinal axis 66. When binding 24 is adapted for use with a snowshoe, latches 78, 80 are generally made of a material that remains durable at cold weather temperatures, e.g., a plastic composite, such as a glass-filled nylon. However, latches 78, 80 may be made of any suitable material, such as a metal, e.g., aluminum, or a metallic or non-metallic composite. Each leg 90 contains an aperture 92 that preferably receives a corresponding one of legs 60 of connecting member 58. Corresponding legs 90 of each latch 78, 80, and tabs 84 of bracket 70, are preferably located in close proximity to, and more preferably in intimate contact with, one another so that there is little or no play between the latches and the bracket in a direction along the corresponding leg of the connecting member. In alternative embodiments, latches 78, 80 may have other shapes in side view. For example, instead of two spaced-apart legs 90 of the U-shape shown, each latch may have a single central leg for positioning between corresponding tabs 84 of bracket 70.

Preferably, only latch 78, the latch opposite from the arch region of a user's foot when footwear 22 is properly secured to binding 24, is pivotable about corresponding leg 60 of connecting member 58. Accordingly, latch 80 is preferably fixed so that it cannot pivot about the corresponding leg 60 connecting member 58. This arrangement provides a balance between the cost of manufacture and the ergonomics of engaging engagement member 26 with binding 24. For example, latch 80 may be fixed with one or more pins 94 extending through apertures 96 in the latch and corresponding apertures 98 in tabs 84 of bracket 70. It is noted that binding system 20 shown in FIGS. 1–7 is intended for the right foot of a user. Accordingly, the locations of the pivotable latch 78 and fixed latch 80 would be reversed for the left-foot binding system. In alternative embodiments, latch 80 may be pivotable and latch 78 fixed or both latches may be pivotable.

As shown in FIG. 5, latch 78 is pivotable about the central axis of leg 60 between a closed position CP and an open position OP. A spring 100 biases latch 78 into closed position CP to facilitate the step-in feature of binding 24. In a presently-preferred embodiment, spring 100 is a helical rotational spring having an outstanding leg 102 at each of its ends for correspondingly engaging a stop 104 on latch 78 and the lower surface of bracket 70. Stop 104 may be a pin or other member extending through aperture 96 in latch 78 or another structure, such as a protuberance (not shown) formed integrally with the latch. In alternative embodiments, spring 100 may be replaced with one or more of another type of biasing means, such as a torsion rod (torsional spring) (see FIGS. 8 and 9 for an example of a torsional spring), a cantilever spring, a coil spring, a resilient cushion or an elastic band, among others. One skilled in the art will appreciate the modifications necessary to adapt binding 24 for such alternative biasing means. If spring 100 is a helical rotational spring as shown, the spring preferably has a spring constant of about 0.3 Nm/degree to about 1.5 Nm/degree, to keep latches 78, 80 engaged with engagement member 26, even under moderate to severe lateral loading conditions. Pivotable latch 78 may optionally be provided with a handle 106 to assist a user in pivoting the latch from closed position CP to open position OP. Handle 106 may be an integral extension of latch 78, as shown, or may be a separate element attached to the latch. Handle 106 may optionally include an aperture 108 for receiving a tether (not shown).

Figure 7A:
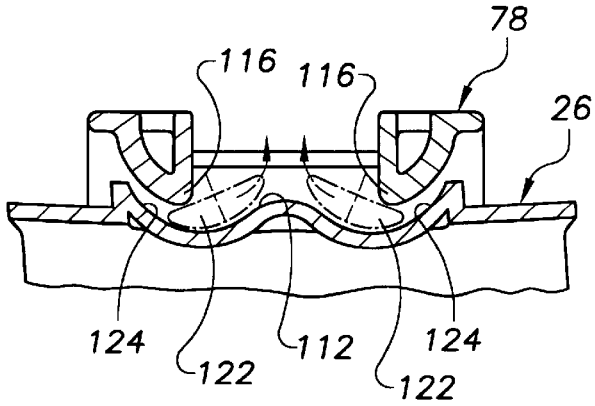
FIG. 7A is a partial cross-sectional view of the latch and receiver as taken along line 7A—7A of FIG. 5, rotated 90°.

Engagement member 26 comprises a pair of receivers 110 (FIG. 5) located in spaced-apart relationship with one another on opposite sides of the engagement member. Engagement member 26 is preferably made of a semi-rigid material, such as nylon or TPU, but may be made of any suitable material, such as metal or a composite material. Referring to FIG. 7A, each receiver 110 preferably comprises a recess 112 that is typically formed integrally with the receiver. Recess 112 includes two cavities 124 that each generally forms a segment of a frustum of a cone so as to appear as a circular segment when viewed in a "horizontal" cross-sectional view, such as FIG. 7A. Engagement member 26 may be attached to footwear 22 by an attachment means (not shown), such as straps, mechanical fasteners, or bonding, among others. In alternative embodiments, engagement member 26 may be integrally formed with footwear 22. For example, recesses 112 may be molded directly into a sole made of an appropriately stiff, durable material. In other alternative embodiments, receivers 110 may be formed separately from footwear 22 and thereafter cast into a sole made of a softer material, such as synthetic rubber, that is typically used for the soles of walking and/or hiking footwear.

Figure 7B:
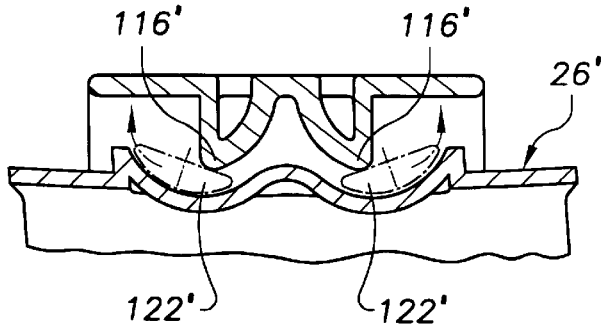
FIG. 7B is a partial cross-sectional view of an alternative embodiment of a latch and receiver similar to the latch and receiver of FIG. 7A.

Each latch 78, 80 includes a pair of catches 116 for matingly engaging corresponding receiver 110 of engagement member 26. In a preferred embodiment, catches 116 of each latch 78, 80 are located in spaced relationship with one another, i.e., located in outboard relation to body 88 of the respective latch, and are shaped to contactingly engage the corresponding receiver 110 at opposing portions thereof when the latches are properly engaged with engagement member 26. In this manner, there is little or no play between binding 24 and engagement member 26 when catches 116 are properly engaged with receivers 110. The generally frusto-conical shape of each catch 116 provides the catch with an upper surface 118 (FIG. 5) that is beveled toward longitudinal axis 66 of binding 24. As described below, beveled upper surfaces 118 cooperate with engagement member 26 to enhance the step-in feature of binding 24. In alternative embodiments, catches 116 may be located in inboard positions, as shown in FIG. 7B.

When view from an end, e.g., in FIG. 5, each latch 78, 80 is preferably generally C-shaped, with catches 116 forming the upper outstanding portion of the C-shape and legs 90 (FIG. 4) forming the lower outstanding portion. Thus, handle 106 of latch 78 may be considered as being attached to the C-shape formed by remaining portions of that latch. It is also preferred that lower edges 120 of catches 116 of each latch 78, 80 define a plane that is substantially parallel with upper surfaces 34, 40 of toe and heel members 28, 30, when the latches are in closed position CP. Lower edges 120 provide an engagement surface for contacting the corresponding receiver 110. Further, it is preferred that the engagement surface of each lower edge 120 have a vertical offset V and a lateral offset L from the center of rotation of the corresponding latch 78, 80 as shown. The geometry of this arrangement, particularly lateral offset L and the orientation of lower edges 120, causes latches 78, 80 to be self clamping in the presence of an upward force U, such as may be caused by the engagement of one of receivers 110 with corresponding catches 116 during use of binding 24. It is noted that the terms "upward" and "vertical" are used only relative to the orientation of binding 24 as shown in the drawings and are not intended to limit the invention in any way since the binding may be used in any orientation, if desired.

The unique shapes and configuration of receivers 110 and catches 116 allow recesses 112 to be substantially cleared of a foreign coherent material 122, such as packed snow and/or ice, that may accumulate in the cavities while binding 24 is not attached to engagement member 26. This may occur, e.g., when a user uses footwear 22 having the engagement member 26 attached thereto to walk around in the snow when the bindings are not attached, or when the bindings are attached in deep snow. As shown in FIG. 7A, as catches 116 engage receiver 110, each catch pushes coherent material 122 against the circular-arced region of inner surface 124 of the corresponding cavity 114 in a manner such that coherent material 122 slides along the inner surface in the direction indicated by the arrows in FIG. 7A, and is ejected from recess 112. The circular-arced region of each cavity 114 generally define two generally symmetric halves. As each catch 116 contacts coherent material 122 in one half, it pushes the coherent material out of the corresponding curvilinear portion in the direction of the other half. The ejected coherent material 122 then passes out through an opening 126 in each latch 78, 80 formed in body 88, i.e., through the central portion of the "U" in the U-shaped body. FIG. 7B shows an alternative arrangement of catches 116' and a corresponding receiver 110' that would also provide binding 24 with the ability to clear coherent material 122' from the receiver as the catches engage the receiver.

Binding system 20, which, as mentioned, is for binding a device to the right leg of a user (not shown), may be used as follows. The user may first secure footwear 22 to his/her right foot and place the device, to which binding 24 has already been installed, on the ground or other generally horizontal surface (not shown) so that latches 78, 80 extend generally upward. The user may then "step into" binding 24 by first tilting his/her right foot laterally with respect to upper surfaces 34, 40 of toe and heel members 28, 30, then engaging cavities 112 of receiver 110 on the instep side of engagement member 26 with the corresponding catches 116 on fixed latch 80 and then rotating his/her foot generally about the instep to engage the engagement member pivotable latch 78. As the user rotates his/her foot in this manner, engagement member 26 first slidingly contacts beveled upper surface 118 of catches 116 to move latch 78 toward its open position OP against the biasing force of spring 100. When footwear 22 comes into proper contact with the respective upper surfaces 34, 40 of toe and heel members 28, 30, spring 100 biases catches 116 of latch 78 into recess 112 of corresponding receiver 110. At this point, pivotable latch 78 is in its closed position CP binding 22 and the device are secured to the right leg of the user.

As discussed above, lateral offset L between the engagement surfaces of catches 116 and the center of rotation of corresponding latch 78, 80 and the orientation of lower edges 120 of the catches tends to cause the latches to rotate inwardly toward longitudinal axis 66 upon application of upward force U to the engagement surfaces of the catches so that binding 24 remains secured to engagement member 26 even under large upward loading condition, such as may occur with snowshoes during walking, particularly in deep, loosely-packed snow. However, to remove footwear 22 from binding 24, the user need only move pivotable latch 78 against the relatively small biasing force of spring 100 to move the latch to its open position OP. This disengages the corresponding catches 116 from corresponding receiver 110 so that the user may then disengage engagement member 26 from fixed latch 80 on the instep by sliding sideways, and/or tilting, his/her foot. After disengaging engagement member 26 from fixed latch 80, the user may then simply step away from binding 24.

Referring now to FIGS. 8 and 9, there is shown another embodiment of a binding system 220 according to the present invention. Many of the features of binding system 220 are similar to binding system 20 described above. However, binding system 220 includes some features not included in binding system 20. Similarly, binding system 20 includes some features not included in binding system 220. One skilled in the art will understand that the features of binding systems 20 and 120 are not exclusive to the respective binding systems. On the contrary, many features of both binding systems may be used with either binding system and with other binding systems made in accordance with the present invention.

Similar to binding system 20, binding system 220 shown is designed for the right leg of a user (not shown) and includes a binding 224 and an engagement member 226. Binding 224 comprises a base 326 that supports latches 278, 280. Base 326 is preferably made of a material that is durable, especially when subjected to cold temperatures of winter weather, e.g., a plastic, such as nylon or TPU. Alternatively, base 326 may be made of another material, such as a metal or a composite. Binding 224 further comprises a sole member 328 for engaging the sole of footwear (not shown) when the footwear is properly engaged with binding 224. Sole member 328 may include a toe portion 330 and a heel portion 332 for engaging, respectively, the toe and heel portions of the sole of the footwear. Sole member 328 is preferably made of the same material as base 326 but may be made of a different material suitable for the intended use of binding system 220. Sole member 328 is attached to base 326, preferably with mechanical fasteners 334. However, sole member 328 may be attached to base 326 by other means, such as adhesive bonding, mechanical engagement and/or heat bonding, among others.

Latches 278, 280 are pivotably secured to binding by four torsion rods, or torsional springs 300, engaged within recesses 336 in base 326 and held in place by sole member 328. Springs 300 are preferably made of metal, e.g., spring steel, but may be made of another material, such as a fiber-reinforced composite. Springs 300 are preferably curved, e.g., in a J-shape, in a plane parallel to upper surface 338 of base 326 to effectively transfer torsional forces within the springs to the base and sole member 328. However, in alternative embodiments, torsion springs 300 may be straight and include other means, such as splines (not shown), for transferring torsional forces within the springs to base 326 and/or sole member 328. Moreover and as one skilled in the art will appreciate, other biasing means, such as the biasing means enumerated above with respect to binding 24, may be used in place of torsional springs 300.

Splines 340 located on the ends of torsional springs 300 matingly engage like-shaped apertures 342 in latches 278, 280 to prevent rotation therebetween. Torsional springs 300 bias latches 278, 280 into their closed positions, which are shown in FIG. 8. Each torsional spring 300 preferably has a spring constant of at least 0.15 Nm/°. Preferably, a gap 344 (FIG. 8) is provided between base 326 and each latch 278, 280 so that torsional springs 300 are unsupported therebetween. This allows for some relative translational movement between latches 278, 280 and base 326. Such movement may be desirable for some applications of binding system 220.

In end view, latches 278, 280 are shaped similar to latches 78, 80 shown in FIGS. 1–7. Thus, latches 278, 280 are self-clamping in a manner similar to latches 78, 80, as described above. However, since both latches 278, 280 are generally pivotable in the present embodiment, both latches preferably include handles 306 to aid a user in moving them from their closed positions to their open positions. Thus, a user can select whichever latch 278, 280 he/she desires to open when disengaging binding 224 from engagement member 226. In some cases, it may be desirable to make one of latches 278, 280 pivotable and the other fixed. Bracket 270 extends between latches 278, 280 to keep the latches properly spaced from one another. Bracket 270 may be secured to each latch 278, 280 by a pin 346 extending through an aperture 296 in the bracket into corresponding apertures 292 in the latches. If springs 300 are sufficiently stiff and base 326 is sufficiently strong to resist lateral forces applied to latches 278, 280, bracket 270 may be eliminated.

Each latch 278, 280 includes a single catch 316 that is matingly engagable with a corresponding similarly-shaped cavity 312 of receiver 310 on engagement member 226. Each catch 316 includes a pair of spaced-apart points 348 that facilitate removal of foreign material (not shown), such as packed snow or ice, that may become lodged within cavities 312. As catch 316 is engaged with corresponding cavity 312, points 348 break up the foreign material and force it out of the cavity. Each latch 278, 280 defines an aperture 350 sufficiently sized to allow the foreign material to be ejected from the corresponding receiver 310 by corresponding latch 278, 280 to be expelled from the region surrounding the receiver. This further prevents the foreign material from further interfering with the proper engagement of catches 316 with receivers 110.

Binding system 220, which is for binding a device (not shown) to the right leg of a user (not shown), may be used as follows. The user may first secure footwear (not shown) to his/her right foot and place the device, to which binding has already been installed, on the ground or other generally horizontal surface so that latches 278, 280 extend generally upward. The user may then align the footwear with binding 224 so that when the user steps into the binding, catches 316 will engage cavities 312 of engagement member 226. The user then moves his/her foot downward so that receivers 310 slidingly contact upper surfaces 318 of catches 316 so as to cause latches 278, 280 to pivot away from one another against the biasing force of springs 300. When sole of the footwear comes into proper contact with sole member 328, springs 300 bias catches 316 of both latches 278, 280 into cavities 312 of the corresponding receivers 310. At this point, binding 224 and device are secured to the right leg of the user.

To remove the footwear from binding 224, the user need only move one or both latches 278, 280 to an open position against the relatively small biasing force of corresponding torsional springs 300 to disengage the corresponding catches 316 from corresponding receiver 310. If the user opens only one of latches 278, 280, the user may disengage engagement member 226 from the other latch by sliding sideways, and/or tilting, his/her foot and then step away from binding. If the user opens both latches 278, 280 simultaneously, the user need only step away from binding 224.

While the present invention has been described in connection with preferred embodiments, it will be understood that it is not so limited. On the contrary, it is intended to cover all alternatives, modifications and equivalents as may be included within the spirit and scope of the invention as defined in the appended claims.

What is claimed is:

1. A binding releasably securable to an engagement member that includes a first side having a first receiver and a second side spaced from the first side and having a second receiver, comprising:

a) a base having an upper surface facing the engagement member when the engagement member is scoured to the binding;

b) a first latch engaging said base and having a first rotational axis, a first position and a second position, said first rotational axis spaced from said upper surface by a first distance, said first latch being pivotable relative to said base between said first position and said second position about said first rotational axis so as to be engaged with the first receiver of the engagement member when in said fast position and out of engagement with the first receiver when in said second position, said first latch including at least one first catch having a first engagement surface spaced from said upper surface of said base by a second distance that is greater than said first distance when said latch is in said first position;

c) a second latch engaging said base in spaced relation to said first latch, said second latch for engaging the second receiver, said second latch having at least one second catch; and d) a first rotational spring engaging said base and said first latch and having a second rotational axis substantially co-linear with said first rotational axis, said first rotational spring biasing said first latch into said first position.

2. A binding according to claim 1, wherein said rotational spring comprises a helical spring.

3. A binding according to claim 1, wherein said rotational spring comprises a torsional spring.

4. A binding according to claim 1, Thither comprising a second rotational spring having a third rotational axis substantially co-linear with said first rotational axis and engaging said first latch and said base and biasing said first latch into said first position.

5. A binding according to claim 4, wherein said first and second rotational springs are torsional springs.

6. A binding according to claim 1, wherein said second latch has a third rotational axis, a third position and a fourth position, said second latch being pivotable relative to said base between said third position and said fourth position about said second rotational axis, the binding further comprising a second rotational spring having a fourth rotational axis substantially co-linear with said third rotational axis and engaging said second latch and said base and biasing said second latch into said third position.

7. A binding according to claim 6, wherein said first rotational spring and said second rotational spring are torsional springs.

8. A binding according to claim 1, wherein said at least one first catch and said at least one second catch extend generally toward one another when said first latch is in said first position.

9. A binding according to claim 1, wherein said first latch comprises a first catch and a second catch spaced from said first catch, said second latch comprises a third catch and a fourth catch spaced from said third catch.

10. A binding according to claim 1, further including a crampon secured to said base.

11. A binding according to claim 1, wherein said base includes a toe member and a heel member, said first latch and second latch each coupled between said toe member and said heel member.

12. A binding according to claim 11, further including an adjustment mechanism attached to said toe member and said heel member for adjusting the position of said toe member and said heel member with respect to one another.

13. A binding according to claim 12, wherein said adjustment mechanism includes a threaded rod extending between said toe member and said heel member and threadedly engaging at least one of said toe member and said heel member.

14. A binding according to claim 11, further comprising a crampon secured to said toe member.

15. A binding system for securing a device to footwear, comprising:

a) an engagement member that includes a first side having a first receiver and a second side spaced from said first side and having a second receiver;

b) a base having an upper surface facing the engagement member when the engagement member is secured to the binding;

c) a first latch engaging said base and having a first rotational axis, a first position and a second position, said first rotational axis spaced from said upper surface by a first distance, said first latch being pivotable relative to said base between said first position and said second position about said first rotational axis so as to be engaged with the first receiver of the engagement member when in said first position and out of engagement with the first receiver when in said second position, said first latch including at least one first catch having a first engagement surface spaced from said upper surface of said base by a second distance that is greater than said first distance when said latch is in said first position;

d) a second latch engaging said base in spaced relation to said first latch, said second latch for engaging said second receiver, said second latch having at least one second catch; and e) a first rotational spring engaging said base and said first latch and having a second rotational axis substantially co-liner with said first rotational axis, said first rotational spring biasing said first latch into said first position.

16. A binding system according to claim 15, wherein said engagement member is formed separate from the footwear and is releasably securable to the footwear.

17. A binding system according to claim 15, wherein said engagement member is formed integrally with the footwear.

18. A binding system according to claim 15, wherein said first latch comprises a first catch and a second catch spaced from said first catch, said second latch comprises a third catch and a fourth catch spaced from said third catch.

19. A binding system according to claim 18, wherein said first receiver comprises a first cavity for receiving said first catch and a second cavity for receiving said second catch, and said second receiver comprises a third cavity for receiving said third catch and a fourth cavity for receiving said fourth catch.

20. A binding according to claim 15, wherein said base includes a toe member and a heel member, said first latch and second latch each coupled between said toe member and said heel member.

21. A binding according to claim 20, further including an adjustment mechanism for adjusting the position of said toe member and said heel member with respect to one another.

22. A binding according to claim 21, wherein said adjustment mechanism includes a threaded rod extending between said toe member and said heel member and threadedly engaging at least one of said toe member and said heel member.

23. A binding capable of resisting a force having a first portion and a second portion and being securable to an engagement member, comprising;

a) a base having an upper surface facing the engagement member when the engagement member is secured to the binding;

b) a first latch engaging said base and having a first rotational axis, a first position and being pivotable into said first position about said first rotational axis, said first rotational axis spaced from said upper surface by a first distance, said first latch having at least one first catch spaced from said upper surface of said base by a second distance that is greater than said first distance when said latch is in said first position, said first latch configured to receive the first portion of the force when said first latch is in said first position so that when the first portion of the force is applied by the engagement member to said at least one first catch in a direction substantially away from said upper surface the first portion of the force biases said first latch into said first position; and c) a first spring engaging said base and said first latch, said first spring biasing said first latch into said first position when the first portion of the force is not acting on said first latch.

24. A binding according to claim 23, wherein said first latch is generally C-shaped and includes at least a first catch for receiving the force and a leg generally parallel to, but spaced from, said first catch, said first catch and said leg forming the two extensions of the C-shape.

25. A binding according to claim 24, wherein said first latch includes a second catch spaced from said first catch, said first catch and said second catch for receiving the force.

26. A binding according to claim 23, further comprising a second latch and a second spring, said second latch spaced from said first latch and having a second rotational axis, a second closed position and being pivotable into said second closed position about said second rotational axis, said second latch configured to receive the second portion of the force when said second latch is in said second closed position so that the second portion of the force biases said second latch into said second closed position.

27. A binding system according to claim 23, wherein said spring is a rotational spring.

28. A binding according to claim 23, further including a sole member, said first and second latches being coupled to said sole member.

29. A binding according to claim 23, wherein the base includes a toe member and a heel member, said first latch and second latch each coupled between said toe member and said heel member.

30. A binding according to claim 29, further including an adjustment mechanism for adjusting the position of said toe member and said heel member with respect to one another.

31. A binding according to claim 30, wherein said adjustment mechanism includes a threaded rod extending between said toe member and said heel member and threadedly engaging at least one of said toe member and said heel member.

32. A binding for securing footwear to a device, comprising:

a) an engagement member securable to the footwear, said engagement member having a receiver defining a first cavity and a second cavity adjacent said first cavity, said first cavity having a cross-sectional shape that generally defines a first circular segment baying a first half and a second halt said second cavity having a cross-sectional shape that generally defines a second circular segment having a third half and a fourth half;

b) a first catch for engaging only one of said first half and said second half of said first cavity; and c) a second catch for engaging only one of said third half and said second half of said second cavity.

33. A binding according to claim 32, further including a base, said first and second catches coupled to said base.

34. A binding according to claim 33, further including a crampon secured to said base.

35. A binding according to claim 33, wherein said base further includes a toe member and a heel member, said first catch and second catch each coupled between said toe member and said heel member.

36. A binding according to claim 35, further including an adjustment mechanism for adjusting the position of said toe member and said heel member with respect to one another.

37. A binding according to claim 36, wherein said adjustment mechanism includes a threaded rod extending between said toe member and said heel member and threadedly engaging at least one of said toe member and said heel member.

38. An engagement member engagable with a pivotable latch comprising a first catch having a substantially planar lower surface and a generally frusto-conically-shaped upper surface, the engagement member comprising:

a) a first surface for engaging the upper surface of the first catch while the engagement member is being engaged with the catch to pivot the latch; and b) a recess for receiving the first catch of the latch, said recess having a substantially planar second surface for contacting the lower surface of the first catch and a generally frusto-conical third surface for confrontingly engaging the upper surface of to first catch.

39. An engagement member according to claim 38, wherein the latch further includes a second catch spaced from the first catch and said recess receives said first catch and said second catch when the engagement member is engaged with the latch.

40. An engagement member according to claim 39, wherein the recess comprises a first cavity for receiving the first catch and a second cavity for receiving the second catch.

41. A binding for receiving footwear having a toe portion, a heel portion and an engagement member having a first receiver and a second receiver located on opposite lateral sides of the engagement member, comprising:

a) a toe member for receiving the toe portion of the footwear;

b) a heel member spaced from said toe member by a distance, said heel member for receiving the heel portion of the footwear;

c) a first means for releasably engaging the first receiver and the second receiver, wherein said first means includes a first latch having at least one first catch for engaging the first receiver and a second latch having at least one second catch for engaging the second receiver; and d) a second means for adjusting said distance between said toe and heel members, said second means extending between said toe and heel members.

42. A binding according to claim 41, wherein said first latch has a closed position and said first means further includes a rotational spring for biasing said first latch into said closed position.

* * * * *

UNITED STATES PATENT AND TRADEMARK OFFICE

CERTIFICATE OF CORRECTION

PATENT NO. : 6,684,534 B2
DATED : February 3, 2004
INVENTOR(S) : David J. Dodge

It is certified that error appears in the above-identified patent and that said Letters Patent is hereby corrected as shown below:

Column 9,
Line 66, delete “scoured” and insert -- secured -- therefor.

Column 10,
Line 8, delete “fast” and insert -- first -- therefor.
Line 28, delete “Thither” and insert -- further -- therefor.

Column 11,
Line 31, delete “co-liner” and insert -- co-linear -- therefor.

Column 12,
Line 60, delete “baying” and insert -- having -- therefor.
Line 61, delete “halt” and insert -- half -- therefor.

Column 13,
Line 28, delete “to” and insert -- the -- therefor.

Signed and Sealed this

Twenty-second Day of June, 2004

JON W. DUDAS
*Acting Director of the United States Patent and Trademark Office*